US010821768B2

(12) United States Patent
Song et al.

(10) Patent No.: US 10,821,768 B2
(45) Date of Patent: Nov. 3, 2020

(54) PICTURE ALBUM

(71) Applicants: Elli Hyunju Song, Chicago, IL (US); Sukho Song, Chicago, IL (US)

(72) Inventors: Elli Hyunju Song, Chicago, IL (US); Sukho Song, Chicago, IL (US)

( * ) Notice: Subject to any disclaimer, the term of this patent is extended or adjusted under 35 U.S.C. 154(b) by 0 days.

(21) Appl. No.: 16/275,068

(22) Filed: Feb. 13, 2019

(65) Prior Publication Data

US 2019/0176508 A1 Jun. 13, 2019

Related U.S. Application Data

(63) Continuation-in-part of application No. 14/204,612, filed on Mar. 11, 2014, now Pat. No. 10,239,341.

(60) Provisional application No. 61/926,965, filed on Jan. 14, 2014, provisional application No. 61/776,713, filed on Mar. 11, 2013.

(51) Int. Cl.

| | |
|---|---|
| ***B42F 13/40*** | (2006.01) |
| ***B42F 13/22*** | (2006.01) |
| ***A47G 1/00*** | (2006.01) |
| ***B42F 13/00*** | (2006.01) |
| ***B42F 5/04*** | (2006.01) |
| ***B42F 5/00*** | (2006.01) |
| ***B42F 13/26*** | (2006.01) |
| ***B42F 13/16*** | (2006.01) |
| ***B42F 11/04*** | (2006.01) |

(52) U.S. Cl.

CPC ..... *B42F 13/40* (2013.01); *A47G 1/00* (2013.01); *B42F 5/00* (2013.01); *B42F 5/04* (2013.01); *B42F 11/04* (2013.01); *B42F 13/0006* (2013.01); *B42F 13/0026* (2013.01); *B42F 13/16* (2013.01); *B42F 13/22* (2013.01); *B42F 13/26* (2013.01)

(58) Field of Classification Search

CPC ..... B42F 13/40; B42F 11/04; B42F 13/0026; B42F 13/26; B42F 13/16

USPC ..... 283/70, 71, 73, 74, 502; 281/4, 17, 19.1, 281/20, 29, 45; 40/700, 702, 705, 706, 40/711, 712, 725, 732, 790

See application file for complete search history.

(56) References Cited

U.S. PATENT DOCUMENTS

| | | | | |
|---|---|---|---|---|
| 2,284,355 A | | 5/1942 | Anderson | |
| 3,456,374 A | * | 7/1969 | Baermann | G03B 21/64 40/600 |
| 5,016,752 A | | 5/1991 | Haugen, Jr. | |

(Continued)

OTHER PUBLICATIONS

Folding wine box: http://www.thenewrange.com.au/2014/product.asp?iProductID=10967&iSubCategory=6698.

(Continued)

*Primary Examiner* — Justin V Lewis

(74) *Attorney, Agent, or Firm* — Faegre Drinker Biddle & Reath LLP

(57) ABSTRACT

A picture frame is provided and includes a body having a front surface and a rear surface. Also included in the picture frame are at least one frame attachment member attached to the rear surface of the body, at least one picture insertion sheet having a pocket configured to hold a picture in the pocket, and at least one sheet attachment member attached to near an outer periphery of each picture insertion sheet. Each picture insertion sheet is removably attached to the rear surface of the body using the at least one frame attachment member and the at least one sheet attachment member.

18 Claims, 10 Drawing Sheets

(56) References Cited

U.S. PATENT DOCUMENTS

| | | | | |
|---|---|---|---|---|
| 5,375,351 | A | 12/1994 | King et al. | |
| 2005/0117964 | A1 | 6/2005 | Johnson | |
| 2005/0193614 | A1* | 9/2005 | Conrad | A47G 1/065<br>40/757 |
| 2006/0038394 | A1 | 2/2006 | Henley | |
| 2009/0090709 | A1 | 4/2009 | Shalomoff | |
| 2012/0037693 | A1 | 2/2012 | Wong | |
| 2013/0161214 | A1 | 6/2013 | Nebeker | |

OTHER PUBLICATIONS

Pioneer PBX-120 3-Ring Photo Album Box: http://www.pfile.com/product/k-pbx-120/?r=GB-K-PBX-120&utm_source=google=products&utm_medium=feed&utm_campaign=GB-K-PBX-120&gclid=CMDdk.

* cited by examiner

PICTURE ALBUM

PRIORITY CLAIM

This application is a continuation-in-part application of U.S. Non-provisional application Ser. No. 14/204,612, titled "PICTURE ALBUM," filed on Mar. 11, 2014, which claims priority to U.S. Provisional Application No. 61/776,713, filed on Mar. 11, 2013, and U.S. Provisional Application No. 61/926,965, filed on Jan. 14, 2014, the entire disclosures of which are expressly incorporated herein by reference in its entirety.

TECHNICAL FIELD

The present disclosure relates generally to picture albums and more particularly to a picture album used as a picture frame.

BACKGROUND

Foldable boxes with collapsible side panels are available in the prior art. However, they require additional flaps or supporting parts to become flat, and they do not provide a clean look or a quick and easy operation. For example, U.S. Pat. No. 8,573,471 can lay flat all side panels, but the operation is assisted by foldable subpanels. The magnets of the prior art are for the purpose of closure only. Picture albums covered in the material for design purpose cannot use the structure of U.S. Pat. No. 8,573,471, because foldable subpanels will increase the thickness and make it difficult to perform the folding function. Also, the prior art was designed for securing packages (i.e. the closed position), not for the constant toggling between two modes of operation: picture frame (closed position) and picture album (open position).

SUMMARY

According to one embodiment of the present disclosure, a picture frame is provided and includes a body having a front surface and a rear surface, at least one frame attachment member attached to the rear surface of the body, at least one picture insertion sheet having a pocket configured to hold a picture in the pocket, and at least one sheet attachment member attached to near an outer periphery of each picture insertion sheet. Each picture insertion sheet is removably attached or embedded to the rear surface of the body using the at least one frame attachment member and the at least one sheet attachment member.

In one example, the attachment of the at least one frame attachment member and the at least one sheet attachment member is achieved under magnetic force.

In another example, the attachment of the at least one frame attachment member and the at least one sheet attachment member is achieved using a hook-and-loop fastener.

In yet another example, the attachment of the at least one frame attachment member and the at least one sheet attachment member is achieved using a temporary adhesive.

In still another example, the body of the picture frame includes an opening configured to display at least a portion of the picture in the pocket. In a variation, each insertion sheet includes a front viewing window configured to display at least the portion of the picture in the pocket via the opening of the picture frame. In another variation, an attachment sequence of the at least one insertion sheet determines a final geometric configuration of the front viewing window shown in the opening of the picture frame. In yet another variation, the front viewing window has a predetermined geometric configuration. In still another variation, the predetermined geometric configuration includes at least one of: a quadrilateral shape, an oval shape, an elliptical shape, a round shape, and an irregular shape.

In a further example, at least one of: the at least one frame attachment member and the at least one sheet attachment member is a magnet.

In yet a further example, at least one of: the at least one frame attachment member and the at least one sheet attachment member is a metal piece.

According to another embodiment of the present disclosure, a picture frame is disclosed and includes a body having a front surface and a rear surface, a plurality of frame attachment members attached to the rear surface of the body, one or more picture insertion sheets, each of the picture insertion sheets having a pocket configured to hold a picture in the pocket, and a plurality of sheet attachment members attached to near an outer periphery of each picture insertion sheet. Each picture insertion sheet is attached to the rear surface of the body by removably attaching each frame attachment member to a corresponding sheet attachment member.

According to yet another embodiment of the present disclosure, a picture frame is disclosed and includes a body having a front surface, a rear surface, and an opening, at least one frame attachment member attached to the rear surface of the body, at least one picture insertion sheet configured to hold a picture, and at least one sheet attachment member attached to near an outer periphery of each picture insertion sheet. Each picture insertion sheet is removably attached to the rear surface of the body using the at least one frame attachment member and the at least one sheet attachment member.

In one example, the opening is configured to display at least a portion of the picture through the opening. In a variation, each insertion sheet includes a front viewing window configured to display at least the portion of the picture via the opening of the picture frame. In another variation, an attachment sequence of the at least one insertion sheet determines a final geometric configuration of the front viewing window shown in the opening of the picture frame. In yet another variation, the front viewing window has a predetermined geometric configuration. In still another variation, the predetermined geometric configuration includes at least one of: a quadrilateral shape, an oval shape, an elliptical shape, a round shape, and an irregular shape.

While multiple embodiments are disclosed, still other embodiments of the present disclosure will become apparent to those skilled in the art from the following detailed description, which shows and describes illustrative embodiments of the disclosure. Accordingly, the drawings and detailed description are to be regarded as illustrative in nature and not restrictive.

BRIEF DESCRIPTION OF THE DRAWINGS

The above-mentioned and other features of this disclosure and the manner of obtaining them will become more apparent and the disclosure itself will be better understood by reference to the following description of embodiments of the present disclosure taken in conjunction with the accompanying drawings, wherein.

Figure 1:
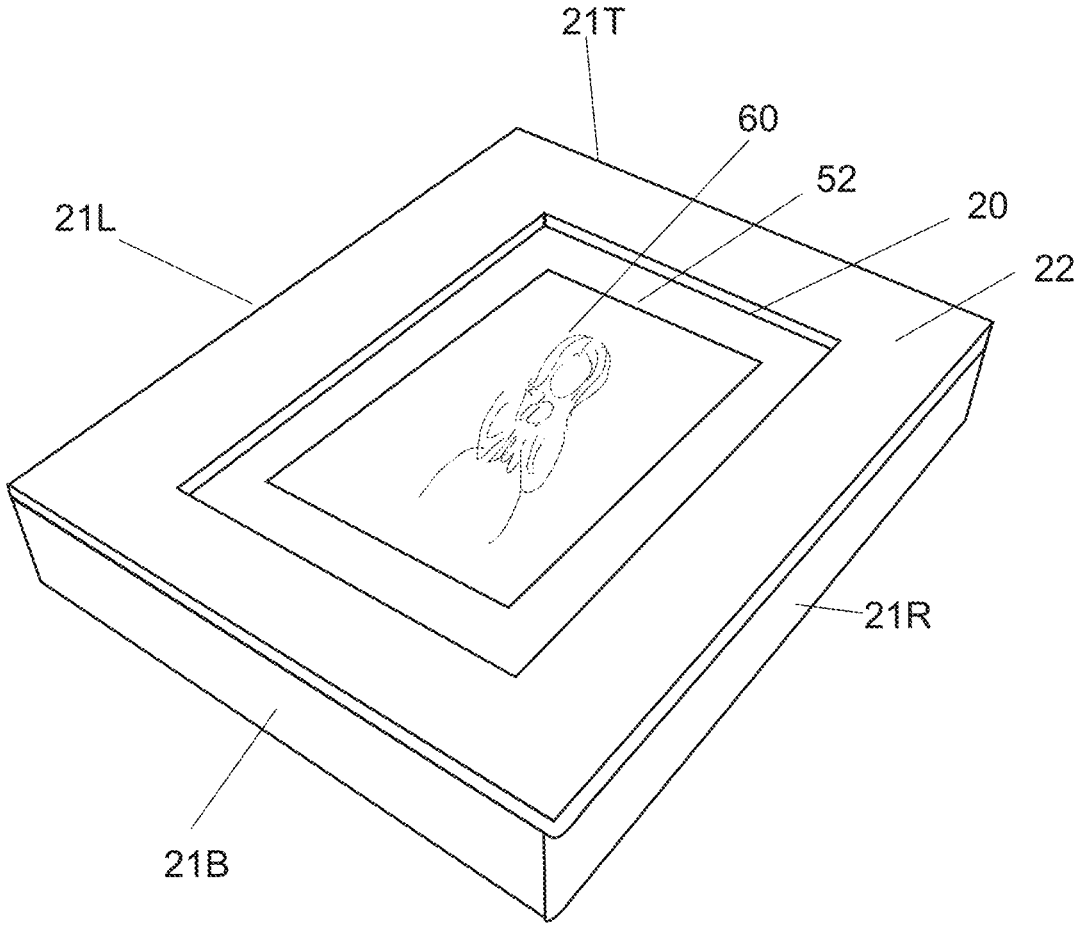
FIG. 1 is a top perspective view from above of a picture album when closed and covered with the material. The picture album contains a picture on the front.

While the present disclosure is amenable to various modifications and alternative forms, specific embodiments have been shown by way of example in the drawings and are described in detail below. The present disclosure, however, is not to limit the particular embodiments described. On the contrary, the present disclosure is intended to cover all modifications, equivalents, and alternatives falling within the scope of the appended claims.

DETAILED DESCRIPTION

The embodiments disclosed below are not intended to be exhaustive or to limit the disclosure to the precise forms disclosed in the following detailed description. Rather, the embodiments are chosen and described so that others skilled in the art may utilize their teachings.

Referring to FIG. 1, one embodiment of the present invention is shown in a front view when the picture album is closed and in the form of a picture frame. A front cover lid panel 22 is rectangular in shape having a picture frame. The frame includes an opening serving as a viewing window 20 for a picture 60. The front cover lid panel 22 is secured to the left side panel 21L of the frame by the material (e.g. fabric, leather, vinyl, etc.), which functions as a hinge. The material is attached to the panels by adhesive, with a small space between adjacent panels, so that the panels can move with respect to each other using the material between the panels as the hinge.

The top side panel 21T, the bottom side panel 21B, and the right side panel 21R are connected to the front cover lid panel 22. A picture 60 on a picture insertion sheet 52 is displayed through a viewing window and through the viewing window 20 on the front cover.

Figure 2:
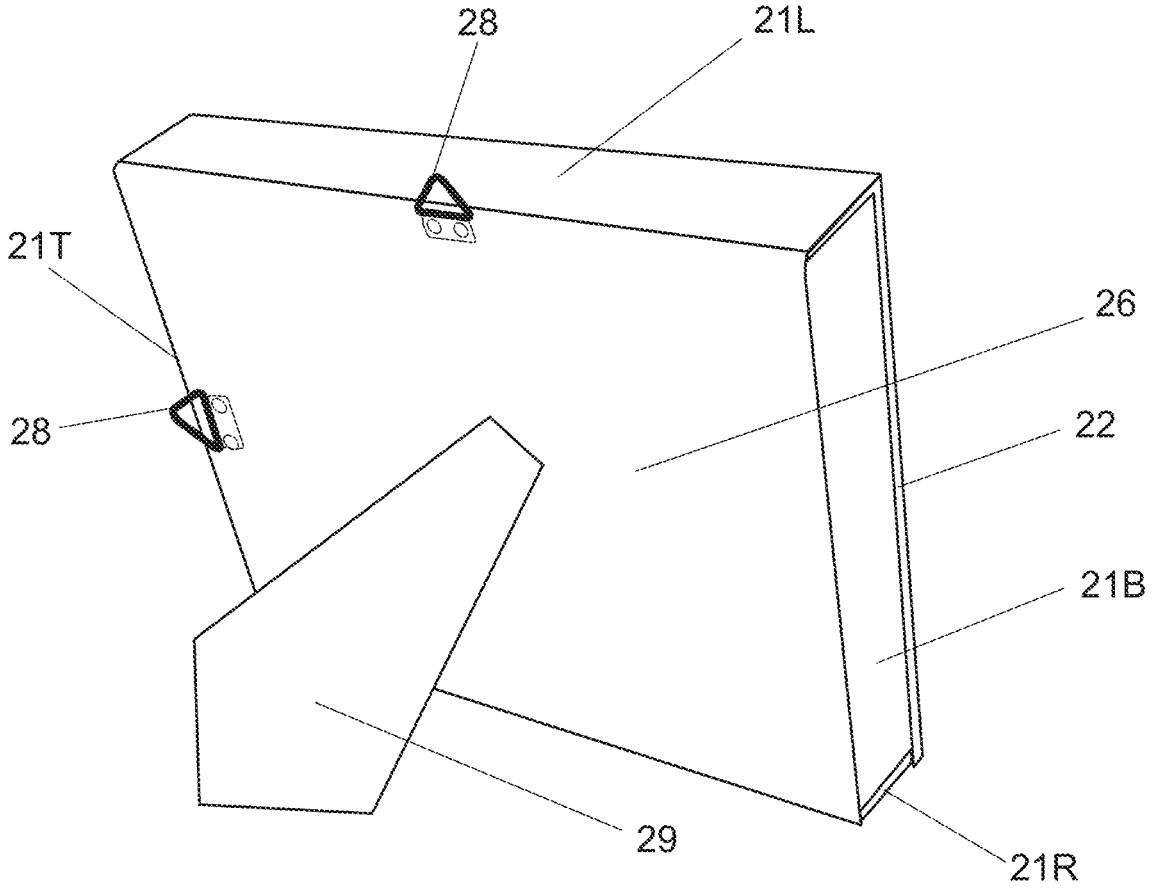
FIG. 2 is a back perspective view from the side of the picture album when closed and covered with the material. The foldable back stand is open to stand the picture album on a flat surface.

Turning to FIG. 2, the picture album is shown in a back view, when it is closed and in the form of a picture frame. A back panel 26 in a rectangular shape is attached to a top side panel 21T, right side panel 21R, bottom side panel 21B, and a left side panel 21L, which connect the back panel 26 to the front cover lid panel 22. The back panel 26 has hanging hardware 28 (e.g. hangers, mounting holes, etc.) to hang the picture album either horizontally or vertically on a wall. The back panel also has a foldable back stand 29 shown in the open position in FIG. 2, which allows the picture album to stand on a flat surface in a portrait or landscape position. In this illustration the picture album is shown covered by the material, with the base structure and magnets unseen.

Figure 3:
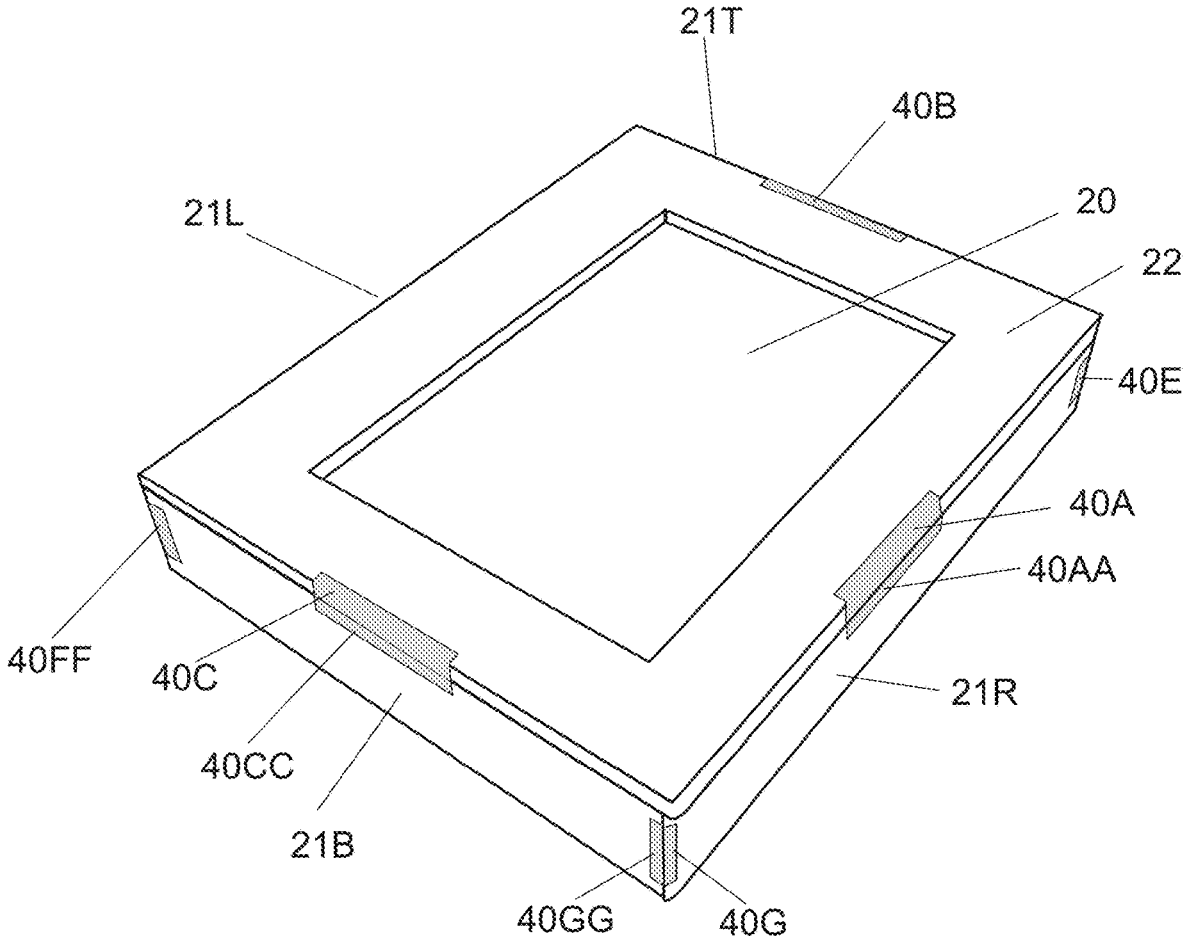
FIG. 3 is a top perspective view from above of the picture album when closed and without the material covering.

In FIG. 3, the picture album is shown in a front view, when it is closed and is in the form of a picture frame. The material is not shown and the base structure and magnets are visible. The front cover lid panel 22 is shown in a rectangular shape and includes an opening serving as the viewing window 20 for a picture. The five panels (21T, 21B, 21L, 21R, and 22) are selectively connected by using the embedded magnets (40A, 40AA, 40B, 40C, 40CC, 40E, 40FF, 40G, and 40GG) by engaging magnetic force.

Figure 4:
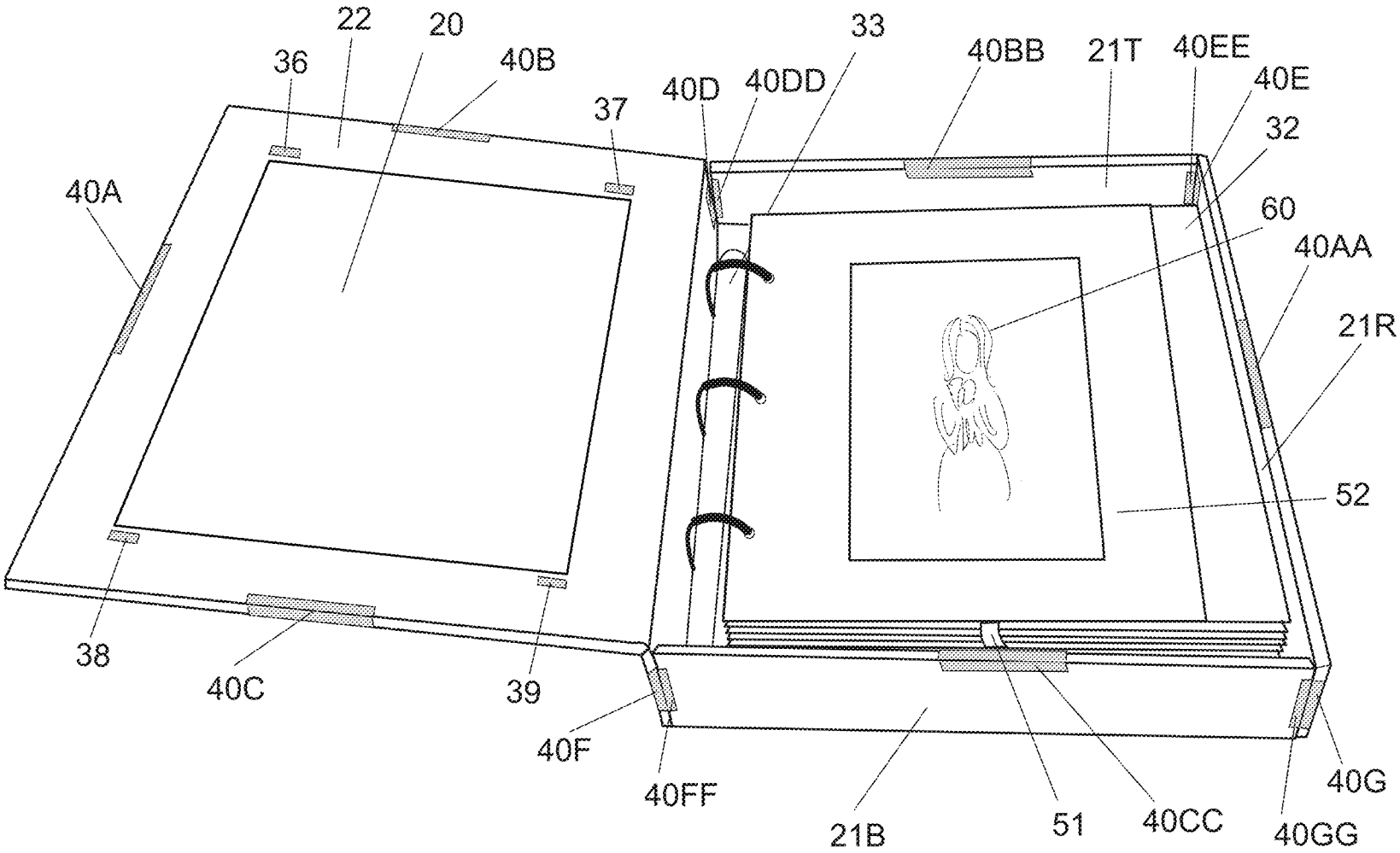
FIG. 4 is a top view of the picture album when the front cover lid panel is opened and is shown without the material covering. A multi-ring binder spine hardware is secured to the back panel with picture sheets and picture insertion sheets stored and organized along the ring binder spine.
Figure 5:
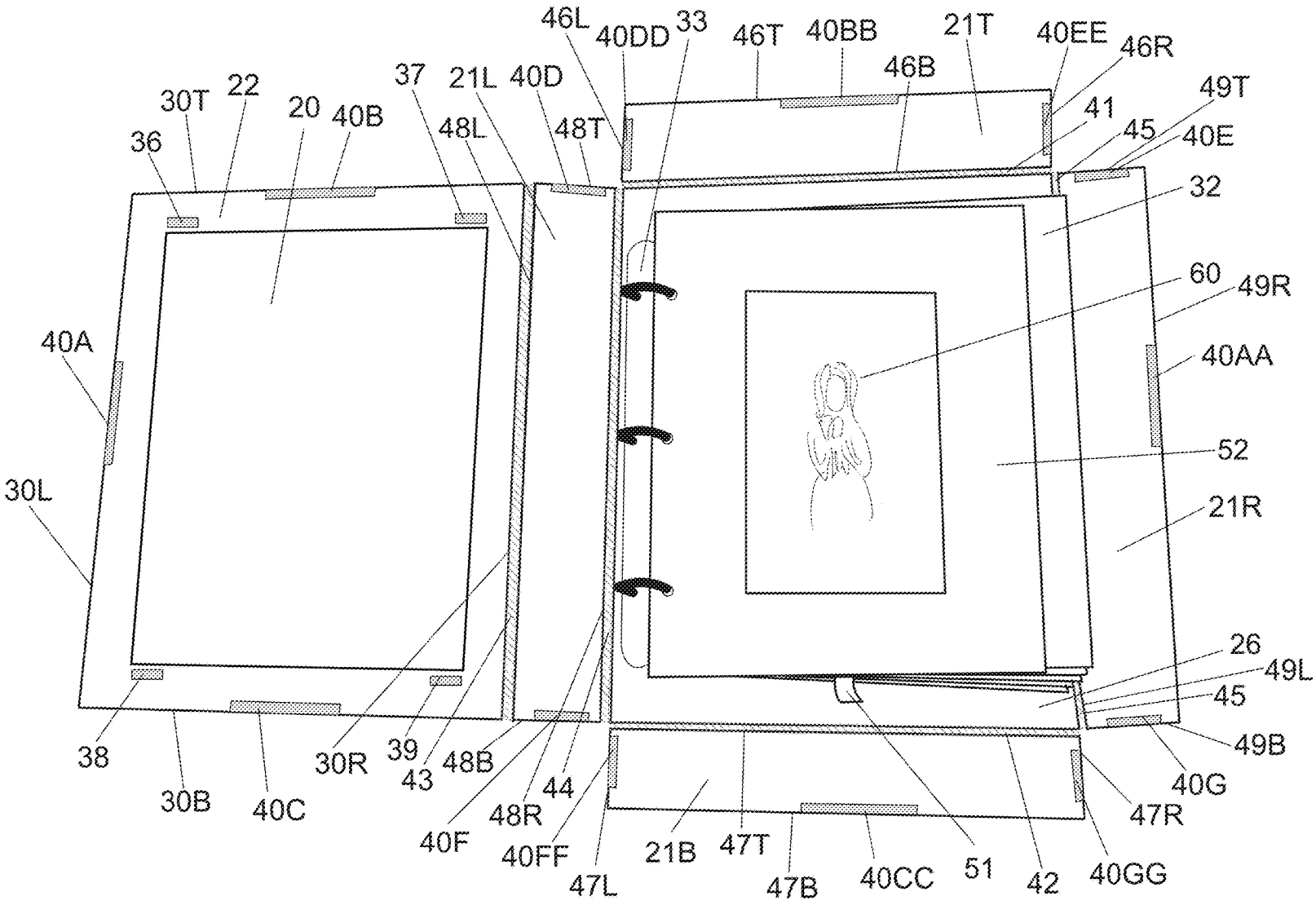
FIG. 5 is a top view of the picture album when the front cover lid panel and all four side panels (top side panel, bottom side panel, left side panel, and right side panel) are opened to lie flat to facilitate organizing pictures inside the album.

FIGS. 4 and 5 show the picture album in the open position and in the form of a picture album. FIG. 4 shows when the front cover lid panel 22 is open and FIG. 5 shows when the five panels (21T, 21B, 21L, 21R, and 22) are opened to lie flat, to facilitate organizing pictures inside the album.

This embodiment of the picture album has the back panel 26 in a rectangular shape attached to the upper side panel 21T, right side panel 21R, lower side panel 21L, and the left side panel 21L, in which the left side panel 21L connects the back panel 26 to the front cover lid panel 22. All the panels have a rigid structure covered by the material and a multi-ring binder spine hardware 33 is secured to the back panel 26 over the material. A plurality of picture sheets 32 or picture insertion sheets 52 may be secured and stored along the multi-ring binder spine.

The upper side panel 21T is in a rectangular shape and has a top edge 46T, a bottom edge 46B opposite the top edge 46T, and left 46L and right 46R side edges. The upper side panel 21T is secured to the back panel 26 by the material, which binds the panels together to produce a hinge at 41 when the material is in place.

A first magnet 4OBB is embedded along the top edge 46T of the upper side panel between the left 46L and right 46R side edges. A second magnet 40DD is embedded along the left side edge 46L of the upper side panel 21T. A third magnet 40EE embedded along the right side 46R edge of the upper side panel 21T. The three magnets embedded in the upper side panel 21T can be aligned to allow the panel to close and secure to the right side panel 21R, left side panel 21L, and front cover lid panel 22 using magnetic force.

The lower side panel 21B is rectangular in shape having, a top edge 47T, a bottom edge 47B opposite the top edge 47T, and left 47L and right 47R side edges. The lower side panel 21B is secured to the back panel 26 by the material, which binds the panels together to produce a hinge at 42 when the material is in place.

A fourth magnet 40CC is embedded along the bottom edge 47B of the lower side panel 21B between the left 47L and right 47R side edges, and a fifth magnet 40FF is embedded along the left side edge 47L of the lower side panel 21B. A sixth magnet 40GG is embedded along the right side edge 47R of the lower side panel 21B. The three magnets embedded in the lower side panel 21B can be aligned to allow the panel to close and secure to the right side panel 21R, left side panel 21L, and front cover lid panel 22 using magnetic force.

A left side panel 21L is rectangular in shape, having a top edge 48T, a bottom edge 48B opposite the top edge 48T, and left 48L and right 48R side edges. The left side panel 21L is secured to the front cover lid panel 22 by the material to produce a hinge at 43 between the left side panel and front lid cover lid panel. The left side panel 21L is secured to the back panel 26 by the material to produce a hinge at 44 between the left side panel 21L and back panel 26.

A seventh magnet 40D is embedded along the top edge 48T of the left side panel 21L, and an eighth magnet 40F is embedded along the bottom edge 48B of the left side panel 21L. The two magnets embedded in the left side panel 21L can be aligned to allow the panel to close, and secure to the upper side panel 21T and lower side panel 21B using magnetic force.

A right side panel 21R is rectangular in shape, having a top edge 49T, a bottom edge 49B opposite the top edge 49T, and left 49L and right 49R side edges, wherein, the right side panel 21R is secured to the back panel 26 by the material which binds the panels together to produce a hinge at 45 when the material is in place. A ninth magnet 40E is embedded along the top edge 49T of the right side panel 21R, and a tenth magnet 40AA is embedded along the right side edge 49R of the right side panel 21R. An eleventh magnet 40G is embedded along the bottom edge 49B of the right side panel 21R. The three magnets embedded in the right side panel 21R can be aligned to allow the panel to close and secure to the upper side panel 21T, lower side panel 21B, and front cover lid panel 22 using magnetic force.

A front cover lid panel 22 is rectangular in shape, having a top edge 30T, a bottom edge 30B opposite the top edge 30T, and left 30L and right 30R side edges, serving as a picture frame, wherein, the front cover lid panel 22 is covered by the material, and secured to the left side panel 21L by the material which binds the panels together to produce the hinge at 43 when the material is in place. The front cover lid panel 22 includes the rectangular opening 20, serving as a viewing window for a picture.

A twelfth magnet 40B is embedded along the top edge 30T of the front cover lid panel 22, and a thirteenth magnet 40A is embedded along the left side edge 30L of the front cover lid panel 22. A fourteenth magnet 40C is embedded along the bottom edge 30B of the front cover lid panel 22. The three magnets embedded in the front cover lid panel 22 can be aligned to allow the panel to close and secure to the upper side panel 21T, lower side panel 21B, and right side panel 21R using magnetic force.

The upper side panel 21T, lower side panel 21B, left side panel 21L, and right side panel 21R are connected to the back panel 26, and can be opened to lie flat to facilitate organizing pictures inside the album. The five panels (21T, 21B, 21L, 21R, and 26) can return to their original shape by using the embedded magnets by engaging the magnets' magnetic force.

Figure 6:
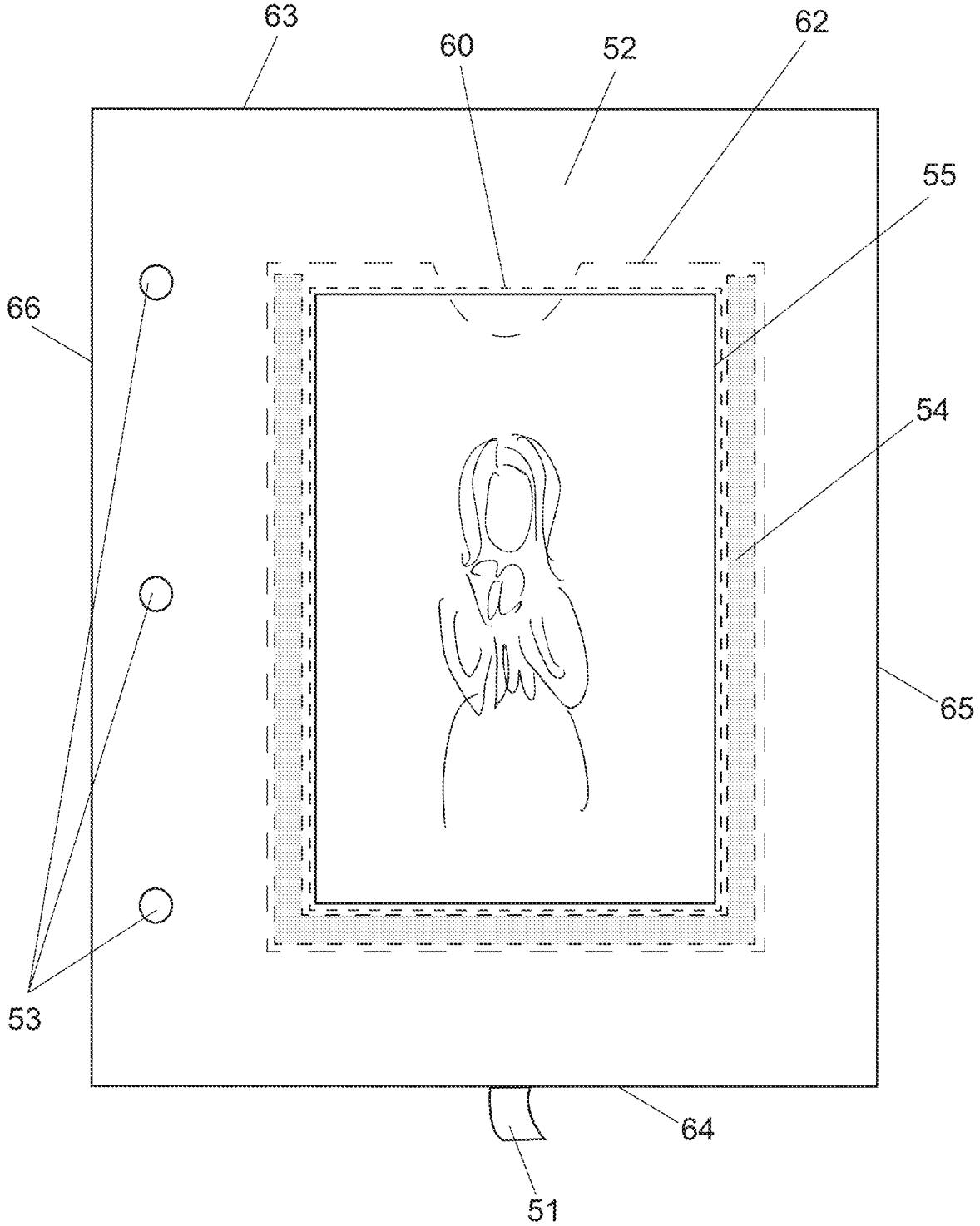
FIG. 6 is a front view of the picture insertion sheet with a picture inserted in the back pocket of a picture insertion sheet.
Figure 7:
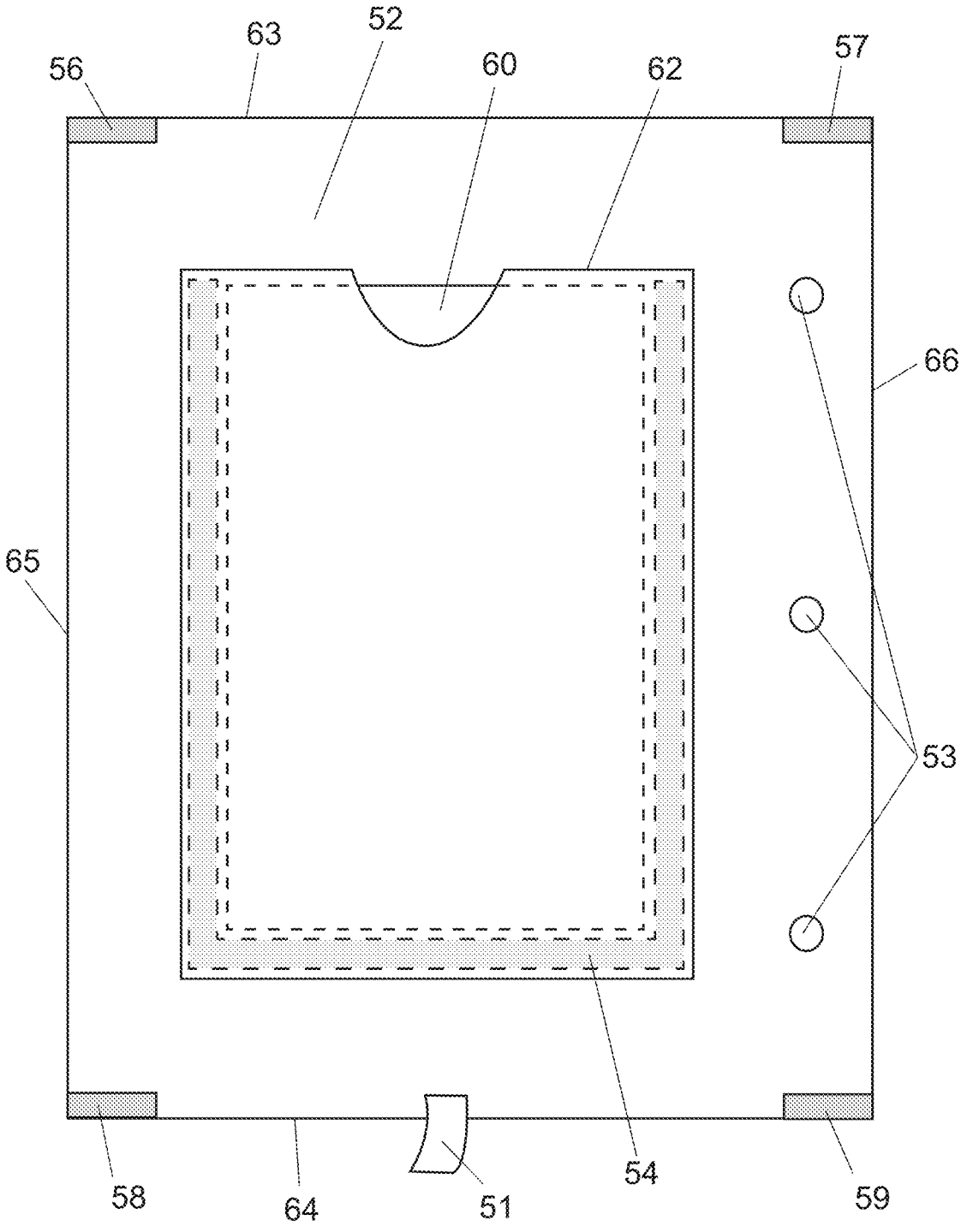
FIG. 7 is a back view of the picture insertion sheet with a picture inserted.

FIG. 6 shows a front view of a picture insertion sheet and FIG. 7 shows a back view of a picture insertion sheet. The picture insertion sheet 52 is of rectangular shape and has a top edge 63, a bottom edge 64 opposite the top edge, and a left edge 66 and a right side edge 65; and a front viewing window 55 of a rectangular, oval, heart or other shape, and a back pocket 62 of rectangular shape. A picture 60 may be inserted into the back pocket 62 so that the picture may be viewed through the front viewing window 55.

Referring to FIG. 7, under the back pocket 62, which holds a picture 60, rail 54 is attached between the picture insertion sheet 52 and the back pocket 62. The rail 54 creates the gap between the picture insertion sheet 52 and the back pocket 62 so that a picture 60 can be inserted smoothly and easily between them. Punch holes 53 are engaged to a multi-ring binder spine hardware 33 to keep the picture sheets 38 and the picture insertion sheets 52.

A pull tab 51 is located along the bottom edge of the picture insertion sheet 52 to facilitate removal of the picture insertion sheet 52 from the front cover lid panel 22. A plurality of magnets on the picture insertion sheet (56, 57, 58 and 59) attach to the corners of the front cover lid using panel magnets 36, 37, 38, and 39 respectively. Attaching the picture insertion sheet 52 to the back of the viewing window in the front cover lid panel 22, allows a picture 60 to be seen through the viewing window 55, as well as through the viewing window 20 located in the front cover lid panel 22.

Figure 8:
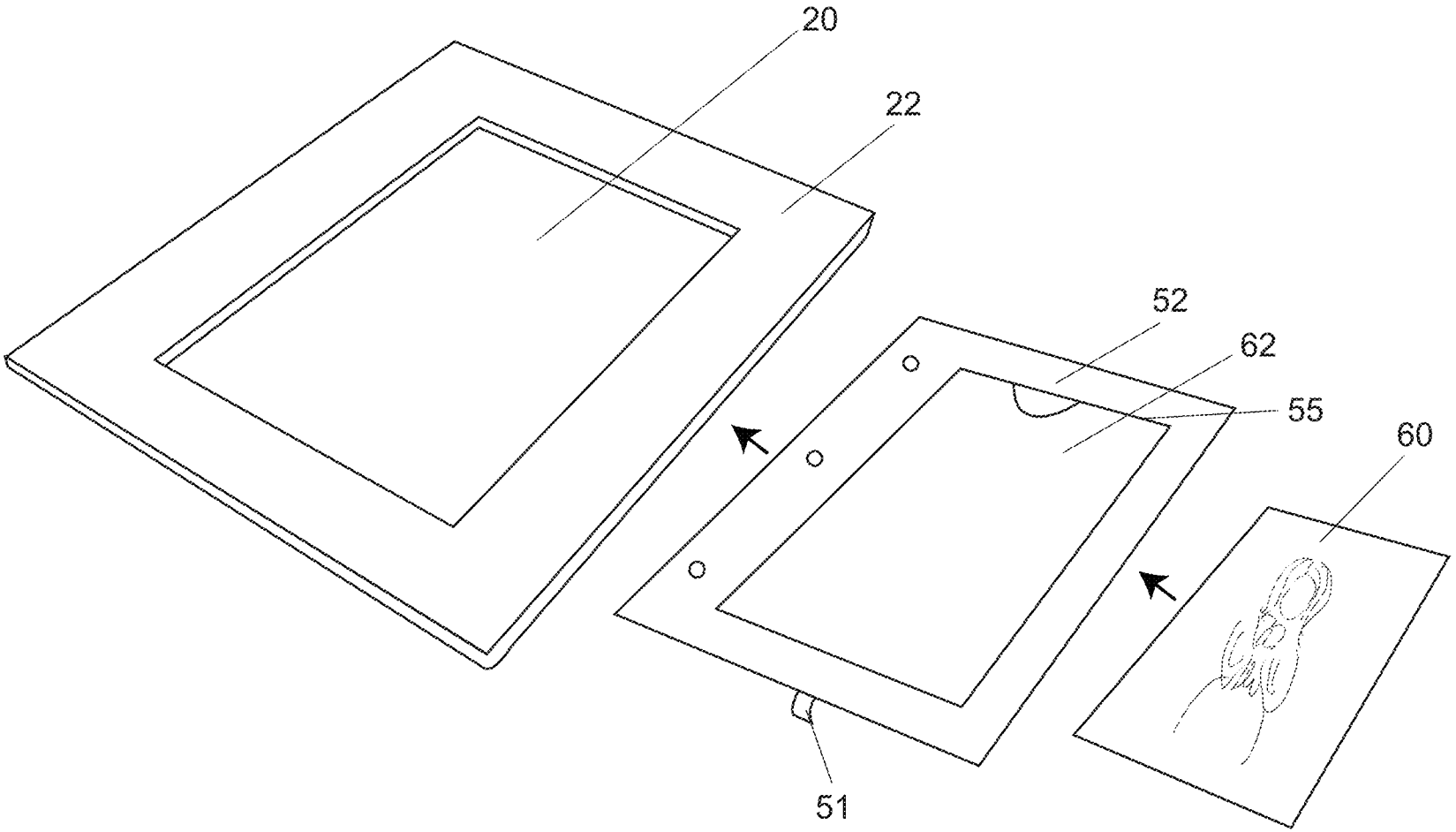
FIG. 8 is a top perspective view showing how to add a picture to display through a viewing window on the picture insertion sheet and then through a viewing window on the front cover lid panel.

FIG. 8 shows how a picture 60 can be viewed in the picture album when it is in the form of a picture frame. A picture 60 will be inserted to the back pocket 62 of a picture insertion sheet 52 and can be seen through the viewing window 55 of the picture insertion sheet 52. Then, the picture insertion sheet 52 will be attached to the back of the front cover lid 22 using magnetic force. The picture 60 will be shown through a viewing window 20 on the front cover lid 22. FIG. 1 shows the final view after assembly.

Figure 9:
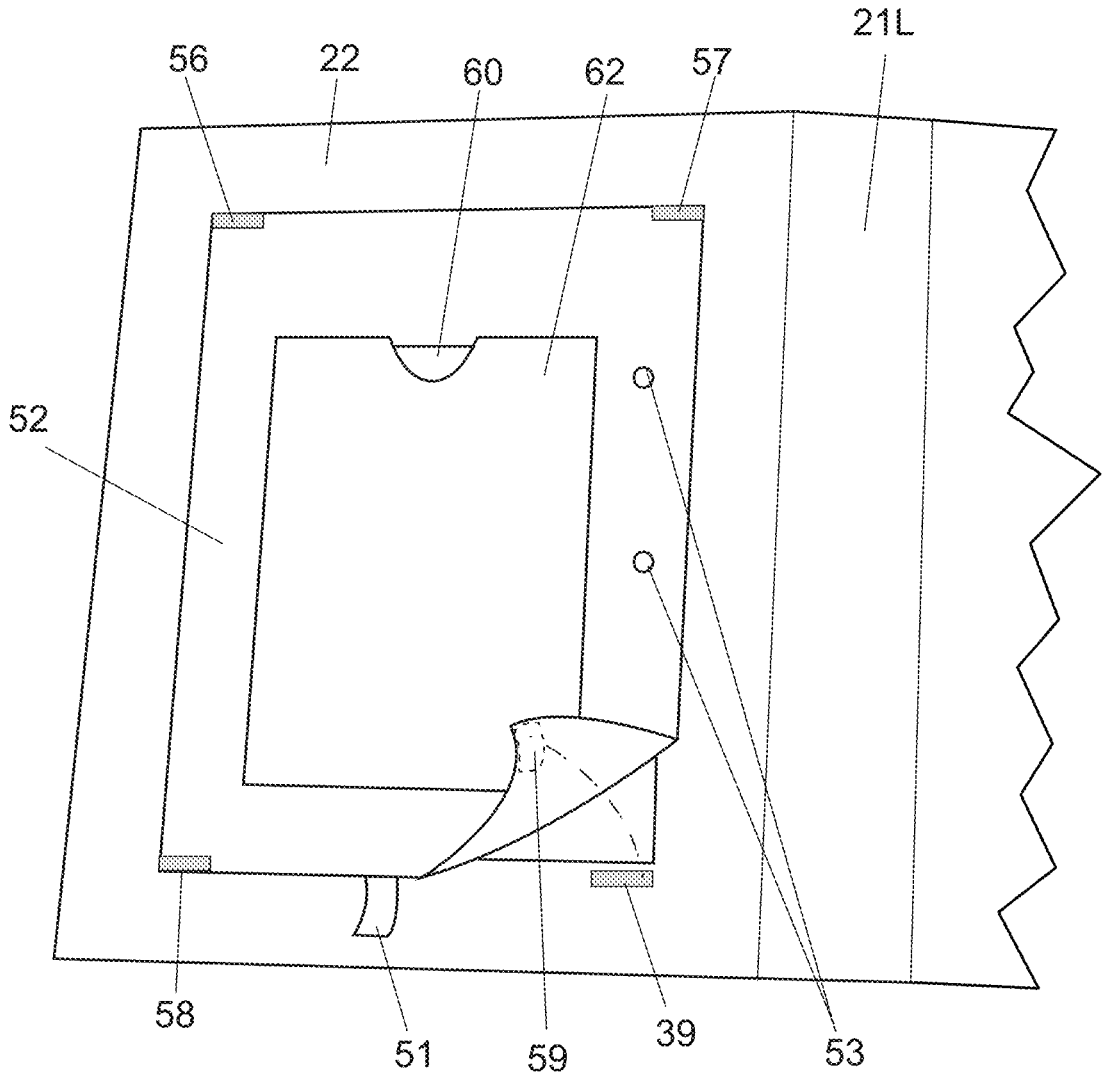
FIG. 9 is a top view of the back of the front cover lid panel of the picture album when the picture insertion sheet with a picture is engaged to the back of the front cover lid. The bottom right corner of the picture insertion sheet is lifted up to show how magnets are engaged between the picture insertion sheet and the front cover lid.

FIG. 9 shows a picture insertion sheet 52 containing a picture 60 after it has been taken out of the binder side and is being placed on the inside of the front cover lid 22. The picture insertion sheet 52 may attach to the back of the viewing window 20 located on the front cover lid panel 22 so that a picture 60 may be seen through both viewing windows (20 and 55). The magnets on the picture insertion sheet 56, 57, 58, and 59 are aligned with magnets on the front cover lid 36, 37, 38 and 39 (see FIG. 4 or 5) by magnetic force. The bottom right corner of a picture insertion sheet 52 is lifted up to show how the magnet 59 on the picture insertion sheet 52 is aligned with the magnet 39 on the front cover lid panel 22.

Figure 10:
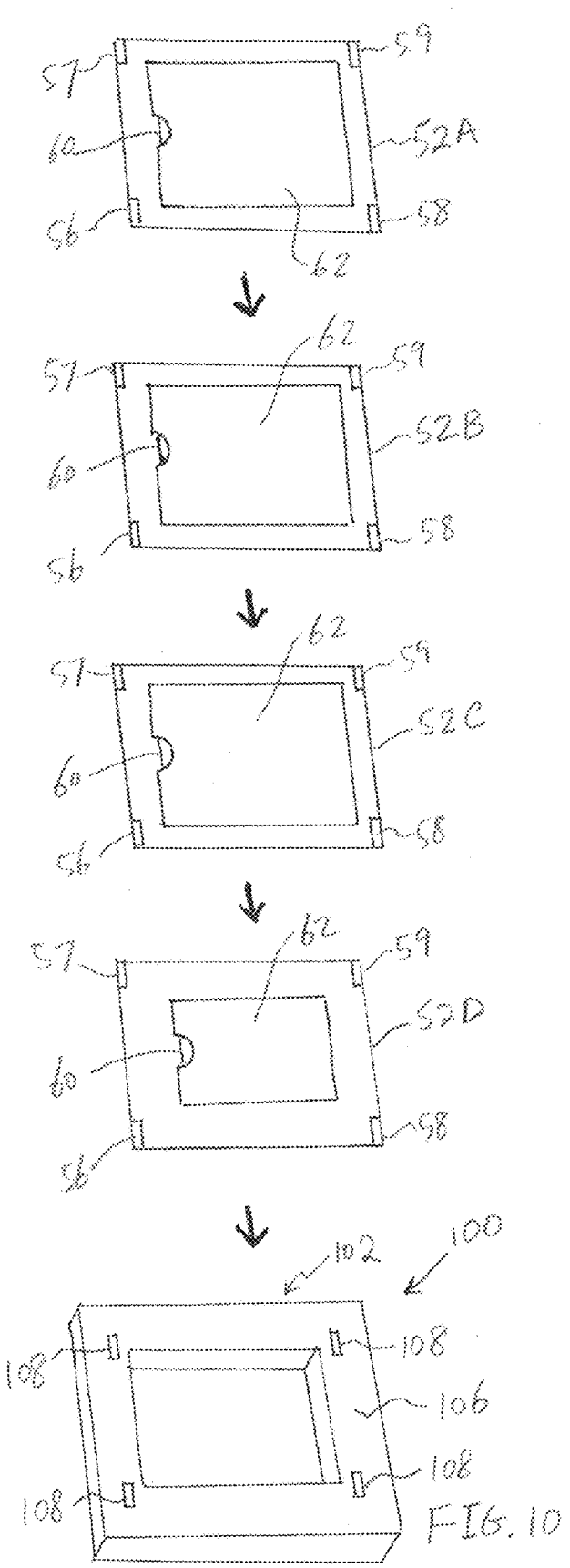
FIG. 10 is a back exploded view of the picture album having a plurality of insertion sheets in accordance with embodiments of the present disclosure.
Figure 11:
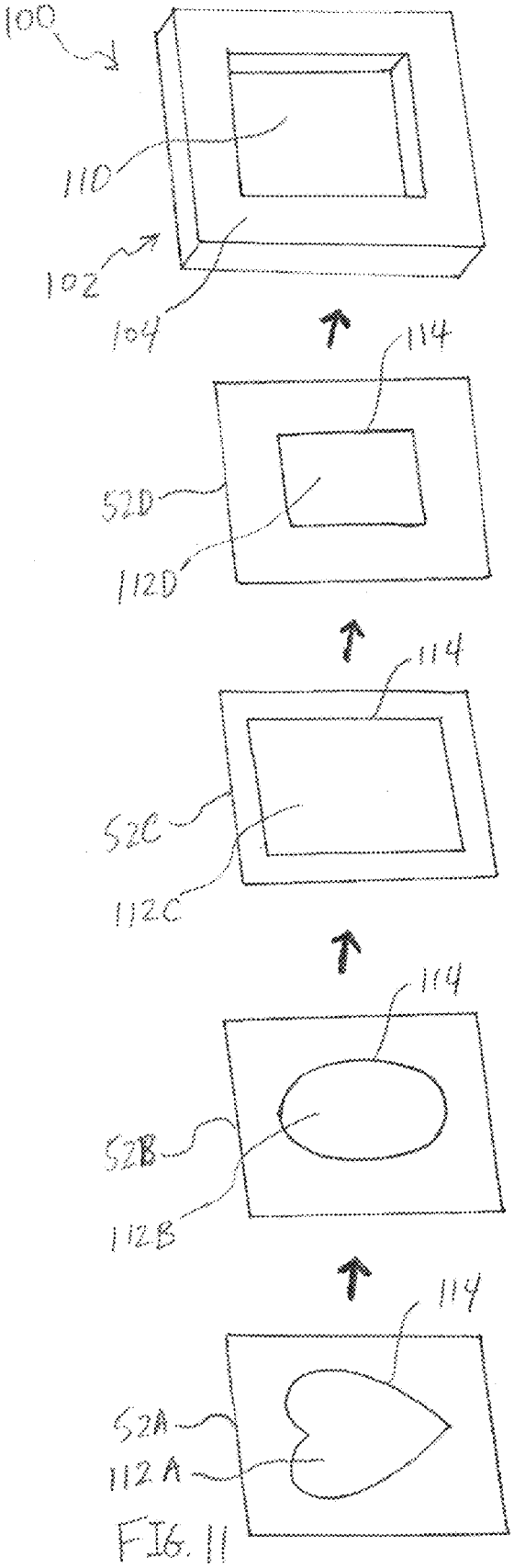
FIG. 11 is a front exploded view of the picture album shown in FIG. 10 where each insertion sheet includes a viewing window.

Referring now to FIGS. 10 and 11, another exemplary picture album of the present disclosure is shown. In FIG. 10, a picture album 100 is shown in a back view and in the form of a picture frame. In one embodiment, the picture frame 100 includes a body 102 having a front surface 104 (FIG. 11) and a rear surface 106 (FIG. 10). In the illustrated embodiment, the body 102 has a quadrilateral shape. In some embodiments, other suitable shapes, such as oval and irregular shapes, are contemplated to suit different applications. For example, the irregular shapes can include a star shape or any two-dimensional shapes. In FIG. 10, one or more frame attachment members 108, such as magnets, hook-and-loop fasteners, or temporary adhesives, are fixedly disposed or embedded/implanted on the rear surface 106 of the picture frame 100. For example, a plurality of magnets 108 can be securely attached or embedded/implanted to four corners of the rear surface 106 of the picture frame 100. Any number of magnets can be used in various embodiments. In embodiments, the temporary adhesives may be adhesive-coated stickers capable of being temporarily attached to the rear surface 106 of the picture frame 100.

One or more insertion sheets 52A, 52B, 52C, 52D can be removably attached to the rear surface 106 of the picture frame 100 using the corresponding magnets 108 of the picture frame 100. As shown in FIG. 7, each insertion sheet 52A, 52B, 52C, 52D includes a back pocket 62 configured to hold a picture 60 therein. In FIG. 10, each insertion sheet 52A, 52B, 52C, 52D has one or more sheet attachment members 56, 57, 58, 59, such as magnets or sheet-metal pieces, that are attached near an outer periphery of the insertion sheet 52A, 52B, 52C, 52D. In the illustrated embodiment, four magnets 56, 57, 58, 59 are attached or embedded/implanted to four corners of each insertion sheet 52A, 52B, 52C, 52D. Attachment of each insertion sheet 52A, 52B, 52C, 52D is achieved by an attractive magnetic force generated by the magnets 56, 57, 58, 59 and the corresponding magnets 108 of the picture frame 100. Other attachment techniques using the hook-and-loop fasteners or temporary adhesives are also contemplated to suit different applications.

In FIG. 11, the body 102 of the picture frame 100 includes an opening 110 to display at least a portion of the picture 60 in the back pocket 62. In the illustrated embodiment, each insertion sheet 52A, 52B, 52C, 52D includes a front viewing window 112A, 112B, 112C, 112D configured to display the portion of the picture 60. Each front viewing window 112A, 112B, 112C, 112D has a specific predetermined geometric configuration. In one embodiment, the geometric configuration refers to a shape and a size of the respective front viewing window 112A, 112B, 112C, 112D. For example, the front viewing window 112A has a heart shape, the front viewing window 112B has a round shape, and the front viewing windows 112C and 112D have a quadrilateral shape (e.g., rectangular or square). Other suitable shapes, such as oval, elliptical, round, or irregular geometric configurations, are also contemplated.

In one embodiment, each insertion sheet 52A, 52B, 52C, 52D is made of a material that is modifiable, e.g., paper, plastic, or garment. Thus, the geometric configuration can be modifiable or variable by changing an inner peripheral edge 114 of the corresponding front viewing window 112A, 112B, 112C, 112D. For example, the inner peripheral edge 114 of the front viewing window 112B having the round shape can be cut to have the rectangular shape of the front viewing window 112C. In another embodiment, each insertion sheet 52A, 52B, 52C, 52D is made of a material that is not readily modifiable, e.g., glass, metal, or carbon fiber. Thus, the geometric configuration can be unmodifiable or fixed. For example, the inner peripheral edge 114 of the front viewing window 112A having the heart shape cannot be easily cut to have the rectangular shape of the front viewing window 112C.

In embodiments, an attachment sequence or order of the insertion sheets 52A, 52B, 52C, 52D determines a final geometric configuration of the corresponding front viewing window 112A, 112B, 112C, 112D shown in the opening 110 of the picture frame 100. For example, as designated by arrows in FIG. 10, one or more insertion sheets 52A, 52B, 52C, 52D can be sequentially attached to the rear surface 106 of the picture frame 100 using the attachment members 56, 57, 58, 59 of the insertion sheets 52A, 52B, 52C, 52D and the corresponding attachment members 108 of the picture frame 100. Thus, when all insertion sheets 52A, 52B, 52C, 52D are attached to the picture frame 100, the geometric configuration of the front viewing window 112A, 112B, 112C, 112D can vary depending on the attachment sequence of the insertion sheets 52A, 52B, 52C, 52D relative to the picture frame 100.

More specifically, as designated by arrows in FIG. 11, if the insertion sheet 52D is attached to the picture frame 100 first and other insertion sheets 52A, 52B, 52C are attached after the insertion sheet 52D, the rectangular shape of the front viewing window 112D is displayed in the opening 110 of the picture frame 100. In another example, if the insertion sheet 52A is attached to the picture frame 100 first and other insertion sheets 52B, 52C, 52D are attached after the insertion sheet 52A, the heart shape of the front viewing window 112A is displayed in the opening 110 of the picture frame 100. Other various arrangements of the insertion sheets 52A, 52B, 52C, 52D are contemplated as desired.

Various modifications and additions can be made to the exemplary embodiments discussed without departing from the scope of the present disclosure. While the embodiments described above refer to particular features, the scope of this disclosure also includes embodiments having different combinations of features and embodiments that do not include all of the described features. Accordingly, the scope of the present disclosure is intended to embrace all such alternatives, modifications, and variations as fall within the scope of the claims, together with all equivalents thereof.

Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements. The scope is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B or C may be present in a single embodiment; for example, A and B, A and C, B and C, or A and B and C.

In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art with the benefit of the present disclosure to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. § 112(f), unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

We claim:

1. A picture frame comprising:

a body having a front surface and a rear surface;

at least one frame attachment member attached to the rear surface of the body;

at least one picture insertion sheet in direct contact with a pocket configured to hold a picture in the pocket; and at least one sheet attachment member attached or embedded to the at least one picture insertion sheet, the at least one sheet attachment member attached or embedded between an outer periphery of the at least one picture insertion sheet and the pocket of the at least one picture insertion sheet, wherein each picture insertion sheet is removably attached to the rear surface of the body using the at least one frame attachment member and the at least one sheet attachment member.

2. The picture frame of claim 1, wherein the attachment of the at least one frame attachment member and the at least one sheet attachment member is achieved by magnetic force.

3. The picture frame of claim 1, wherein the attachment of the at least one frame attachment member and the at least one sheet attachment member is achieved using a hook-and-loop fastener.

4. The picture frame of claim 1, wherein the attachment of the at least one frame attachment member and the at least one sheet attachment member is achieved using a temporary adhesive.

5. The picture frame of claim 1, wherein the body of the picture frame includes an opening configured to display at least a portion of the picture in the pocket.

6. The picture frame of claim 5, wherein each insertion sheet includes a front viewing window configured to display at least the portion of the picture in the pocket via the opening of the picture frame.

7. The picture frame of claim 6, wherein an attachment sequence of the at least one insertion sheet determines a final geometric configuration of the front viewing window shown in the opening of the picture frame.

8. The picture frame of claim 6, wherein the front viewing window has a predetermined geometric configuration.

9. The picture frame of claim 8, wherein the predetermined geometric configuration includes at least one of: a quadrilateral shape, an oval shape, an elliptical shape, a round shape, a star shape, and a valentine heart shape.

10. The picture frame of claim 1, wherein at least one of: the at least one frame attachment member and the at least one sheet attachment member is a magnet.

11. The picture frame of claim 1, wherein at least one of: the at least one frame attachment member and the at least one sheet attachment member is a metal piece.

12. A picture frame comprising:

a body having a front surface and a rear surface;

a plurality of frame attachment members attached to the rear surface of the body;

one or more picture insertion sheets, each of the picture insertion sheets in direct contact with a pocket configured to hold a picture in the pocket; and a plurality of sheet attachment members attached or embedded to each of the picture insertion sheets, the plurality of sheet attachment members attached or embedded between an outer periphery of each of the picture insertion sheets and the pocket of each of the picture insertion sheets, wherein each picture insertion sheet is attached to the rear surface of the body by removably attaching each frame attachment member to a corresponding sheet attachment member.

13. A picture frame comprising:

a body having a front surface, a rear surface, and an opening;

at least one frame attachment member attached to the rear surface of the body;

at least one picture insertion sheet configured to directly hold a picture; and at least one sheet attachment member attached to the at least one picture insertion sheet, wherein each picture insertion sheet is removably attached to the rear surface of the body using the at least one frame attachment member and the at least one sheet attachment member, the at least one sheet attachment member positioned between the opening of the body and an outer periphery of the at least one picture insertion sheet when removably coupled to the at least one frame attachment member.

14. The picture frame of claim 13, wherein the opening is configured to display at least a portion of the picture through the opening.

15. The picture frame of claim 14, wherein each insertion sheet includes a front viewing window configured to display at least the portion of the picture via the opening of the picture frame.

16. The picture frame of claim 15, wherein an attachment sequence of the at least one insertion sheet determines a final geometric configuration of the front viewing window shown in the opening of the picture frame.

17. The picture frame of claim 15, wherein the front viewing window has a predetermined geometric configuration.

18. The picture frame of claim 17, wherein the predetermined geometric configuration includes at least one of: a quadrilateral shape, an oval shape, an elliptical shape, a round shape, a star shape, and a valentine heart shape.

* * * * *